US010490372B2

(12) United States Patent
Rached

(10) Patent No.: US 10,490,372 B2
(45) Date of Patent: Nov. 26, 2019

(54) USE OF HEXAFLUOROBUTENES FOR ISOLATING OR EXTINGUISHING ELECTRIC ARCS

(71) Applicant: Arkema France, Colombes (FR)

(72) Inventor: Wissam Rached, Chaponost (FR)

(73) Assignee: Arkema France, Colombes (FR)

( * ) Notice: Subject to any disclaimer, the term of this patent is extended or adjusted under 35 U.S.C. 154(b) by 0 days.

(21) Appl. No.: 15/755,635

(22) PCT Filed: Aug. 16, 2016

(86) PCT No.: PCT/FR2016/052081

§ 371 (c)(1),
(2) Date: Feb. 27, 2018

(87) PCT Pub. No.: WO2017/037360

PCT Pub. Date: Mar. 9, 2017

(65) Prior Publication Data

US 2018/0247779 A1 Aug. 30, 2018

(30) Foreign Application Priority Data

Aug. 28, 2015 (FR) ..... 15 57996

(51) Int. Cl.

| | |
|---|---|
| ***H01H 3/56*** | (2006.01) |
| ***H01H 33/22*** | (2006.01) |
| ***H01H 33/56*** | (2006.01) |
| ***H01B 3/56*** | (2006.01) |

(52) U.S. Cl.
CPC ..... *H01H 33/22* (2013.01); *H01B 3/56* (2013.01); *H01H 2033/566* (2013.01)

(58) Field of Classification Search
CPC .... H01H 33/22; H01H 2033/566; H01B 3/56; C09K 2205/12; C09K 2205/126; C09K 2205/22; C09K 5/045; H02B 13/055
USPC ..... 218/85, 91, 97
See application file for complete search history.

(56) References Cited

U.S. PATENT DOCUMENTS

| | | | | |
|---|---|---|---|---|
| 6,504,125 | B2 * | 1/2003 | Nishitani | H02B 13/045 218/155 |
| 7,250,583 | B2 * | 7/2007 | Cameroni | H01H 33/122 218/14 |
| 8,524,955 | B2 * | 9/2013 | Poss | C07C 17/23 570/153 |
| 2007/0096051 | A1 | 5/2007 | Nappa et al. | |
| 2011/0144216 | A1 * | 6/2011 | Hulse | A01N 29/02 514/757 |
| 2012/0104307 | A1 * | 5/2012 | Bogdan | C08J 9/149 252/62 |
| 2013/0255284 | A1 * | 10/2013 | Rached | C09K 5/045 62/77 |
| 2014/0284516 | A1 | 9/2014 | Johnsen | |
| 2015/0096312 | A1 * | 4/2015 | Rached | C09K 5/045 62/114 |
| 2015/0191576 | A1 * | 7/2015 | Robin | C08J 9/146 252/8 |
| 2015/0197677 | A1 * | 7/2015 | Kontomaris | C09K 5/045 62/77 |

FOREIGN PATENT DOCUMENTS

| | | |
|---|---|---|
| CN | 102460604 A | 5/2012 |
| CN | 104220553 A | 12/2014 |
| FR | 2 989 084 | 10/2013 |

OTHER PUBLICATIONS

International Search Report dated Nov. 7, 2016 for PCT/FR2016/052081.

* cited by examiner

*Primary Examiner* — Edwin A. Leon
*Assistant Examiner* — William A Bolton
(74) *Attorney, Agent, or Firm* — NK Patent Law

(57) ABSTRACT

The invention relates to the use of a gas as a medium for electrically isolating and/or extinguishing electric arcs, said gas comprising a hexafluorobutene. The invention also relates to an electric device comprising a sealed chamber inside which electric components and said gas are located.

5 Claims, No Drawings

USE OF HEXAFLUOROBUTENES FOR ISOLATING OR EXTINGUISHING ELECTRIC ARCS

CROSS-REFERENCE TO RELATED APPLICATIONS

This application is a U.S. National Stage application of International Application No. PCT/FR2016/052081, filed Aug. 16, 2016, which claims the benefit of French Application No. 1557996, filed Aug. 28, 2015.

FIELD OF THE INVENTION

The present invention relates to a gas used for the electrical insulation or the extinguishing of electric arcs and also to electric appliances provided with a chamber containing this gas.

TECHNICAL BACKGROUND

In medium- or high-voltage electrical appliances, the electrical insulation and, if appropriate, the extinguishing of the electric arcs are typically provided by a gas which is confined inside a chamber of these appliances. Currently, the gas which is most often used is sulfur hexafluoride ($SF_6$): this gas exhibits a relatively high dielectric strength, a good thermal conductivity and relatively low dielectric losses. It is chemically inert and nontoxic to man and animals, and, after having been dissociated by an electric arc, it rapidly and virtually completely recombines. Furthermore, it is nonflammable and its cost is, even today, moderate.

However, $SF_6$ has the major disadvantage of exhibiting a global warming potential (GWP) of 22 800 (relative to $CO_2$ over 100 years) and a residence time in the atmosphere of 3 200 years, which places it among the gases having a high greenhouse effect power.

Manufacturers are thus looking for alternatives to $SF_6$. Hybrid systems have been provided, which systems combine gas insulation with solid insulation (document EP 1 724 802). However, this increases the size of the electric appliances, in comparison with that allowed by insulation with $SF_6$, and the cutting in oil or vacuum requires a recasting of the items of equipment.

The use is known, alternatively to $SF_6$, of "simple" gases, such as air or nitrogen, which do not have a negative impact on the environment. However, these exhibit a much lower dielectric strength than that of $SF_6$; their use for the electrical insulation and/or the extinguishing of electric arcs in high-voltage/medium-voltage appliances involves drastically increasing the volume and/or the filling pressure of these appliances, which runs counter to efforts which have been made in recent decades to develop compact electrical appliances which are increasingly less bulky.

Perfluorocarbons exhibit, generally, advantageous dielectric strength properties but their GWP typically comes within a range extending from 5000 to 10 000.

Other promising alternatives from an electrical and GWP characteristics viewpoint, such as trifluoroiodomethane, are categorized among category-3 carcinogenic, mutagenic and reprotoxic substances, which is totally unacceptable for use on an industrial scale.

Mixtures of $SF_6$ and of other gases, such as nitrogen and nitrogen dioxide, are used to limit the impact of $SF_6$ on the environment: see, for example, the document WO 2009/049144. Nevertheless, as a result of the high GWP of $SF_6$, the GWP of these mixtures remains very high. Thus, for example, a mixture of $SF_6$ and nitrogen in a ratio by volume of 10/90 exhibits a dielectric strength in alternating voltage (50 Hz) equal to 59% of that of $SF_6$ but its GWP is of the order of 8000 to 8650. Such mixtures thus cannot be used as gas having a low environmental impact.

The document FR 2 955 970 provides for the use of fluoroketones in the gas state for electrical insulation. Fluoroketones can be combined with a carrier gas or dilution gas (for example nitrogen, air, nitrous oxide, carbon dioxide, oxygen, helium and the like).

The document FR 2 975 818 provides a mixture of octofluorobutan-2-one and carrier gas as insulation medium.

The document FR 2 983 341 provides for the use of polyfluorinated oxiranes as electrical insulation and/or extinguishing gas for electric arcs.

The document FR 2 986 192 provides for the use of a combination of poly fluorinated oxirane and hydrofluoroolefin as electrical insulation gas. The hydrofluoroolefins mentioned are 1,3,3,3-tetrafluoropropene (HFO-1234ze), 2,3,3,3-tetrafluoropropene (HFO-1234yf) and 1,2,3,3,3-pentafluoropropene (HFO-1225ye).

The document WO 2012/038443 provides for the use of a mixture of $SF_6$ and fluoroketone as electrical insulation gas.

The document WO 2012/160158 provides for the use of a mixture of decafluoro-2-methylbutan-3-one and a carrier gas as electrical insulation gas.

The document WO 2013/004796 provides for the use of a gas based on hydrofluoroolefin as electrical insulation gas. The hydrofluoroolefins more particularly provided are 1,3,3,3-tetrafluoropropene (HFO-1234ze) and 2,3,3,3-tetrafluoropropene (HFO-1234yf).

The document WO 2013/041695 provides for the use of a mixture of hydrofluoroolefin and fluoroketone as electrical insulation gas. The hydrofluoroolefins more particularly provided are 1,3,3,3-tetrafluoropropene (HFO-1234ze), 2,3,3,3-tetrafluoropropene (HFO-1234yf) and 1,2,3,3,3-pentafluoropropene (HFO-1225ye).

The document WO 2013/136015 provides for the use of a mixture of hydrofluoroolefin and hydrofluorocarbon as electrical insulation gas. The hydrofluoroolefins more particularly provided are 1,3,3,3-tetrafluoropropene (HFO-1234ze), 2,3,3,3-tetrafluoropropene (HFO-1234yf) and 1,2,3,3,3-pentafluoropropene (HFO-1225ye). The hydrofluorocarbons more particularly provided are 1,1,1,2,3,3,3-heptafluoropropane (HFC-227ea), pentafluoroethane (HFC-125) and 1,1,1,2-tetrafluoroethane (HFC-134a).

There still exists a need to develop electrical insulation and/or extinguishing media for electric arcs exhibiting both a low GWP and exhibiting a high dielectric strength.

SUMMARY OF THE INVENTION

The invention relates first to the use of a gas as electrical insulation and/or extinguishing medium for electric arcs, wherein the gas comprises a hexafluorobutene.

According to one embodiment, the hexafluorobutene is 1,1,1,4,4,4-hexafluorobut-2-ene, preferably in the trans form, or 2,3,3,4,4,4-hexafluorobut-1-ene.

According to one embodiment, the use is a use as electrical insulation and/or extinguishing medium for electric arcs in a medium-voltage electrical substation appliance.

According to one embodiment, the gas contains:

from 10 to 100 mol % of trans-1,1,1,4,4,4-hexafluorobut-2-ene, preferably from 20 to 75 mol % and more particularly preferably from 30 to 40 mol %; and/or from 25 to 100 mol % of 2,3,3,4,4,4-hexafluorobut-1-ene, preferably from 35 to 75 mol % and more particularly preferably from 45 to 55 mol %.

According to one embodiment, the gas also comprises a diluant, preferably chosen from air, nitrogen, methane, oxygen, carbon dioxide or a mixture of these, and the gas is preferably a binary mixture of a hexafluorobutene and a diluant.

According to one embodiment, the use is carried out in a temperature range, the lower limit of which has a value from −30 to 20° C., preferably from −20 to 10° C., more particularly preferably from −15 to 0° C.

According to an alternative embodiment, the gas consists essentially, and preferably consists, of a hexafluorobutene or a mixture of hexafluorobutenes.

In such cases, according to one embodiment, the use is carried out in a temperature range, the lower limit of which is greater than or equal to 0° C., or greater than or equal to 2° C., or greater than or equal to 5° C., or greater than or equal to 10° C.

The invention also relates to an electrical appliance comprising a leaktight chamber in which electrical components and also an electrical insulation and/or extinguishing gas for electric arcs are found, wherein the gas comprises a hexafluorobutene.

According to one embodiment, the hexafluorobutene is 1,1,1,4,4,4-hexafluorobut-2-ene, preferably in the trans form, or 2,3,3,4,4,4-hexafluorobut-1-ene.

According to one embodiment, the gas contains:

from 10 to 100 mol % of trans-1,1,1,4,4,4-hexafluorobut-2-ene, preferably from 20 to 75 mol % and more particularly preferably from 30 to 40 mol %; and/or from 25 to 100 mol % of 2,3,3,4,4,4-hexafluorobut-1-ene, preferably from 35 to 75 mol % and more particularly preferably from 45 to 55 mol %.

According to one embodiment, the gas also comprises a diluant, preferably chosen from air, nitrogen, methane, oxygen, carbon dioxide or a mixture of these, and the gas is preferably a binary mixture of a hexafluorobutene and a diluant.

According to an alternative embodiment, the gas consists essentially, and preferably consists, of a hexafluorobutene or a mixture of hexafluorobutenes.

According to one embodiment, the electrical appliance is a medium-voltage electrical appliance.

According to one embodiment, the gas is at a pressure, at 20° C., of 0.1 to 1 MPa, preferably of 0.11 to 0.5 MPa and more particularly of 0.12 to 0.15 MPa.

According to one embodiment, the electrical appliance is chosen from a gas-insulated electrical transformer, a gas-insulated line for the transportation or the distribution of electricity, and an electrical connection/disconnection appliance.

The present invention makes it possible to overcome the disadvantages of the state of the art. It more particularly provides electrical insulation and/or extinguishing media for electric arcs exhibiting both a low GWP and exhibiting a high dielectric strength.

This is accomplished by virtue of the discovery that the media based on hexafluorobutene, or HFO-1336, exhibit noteworthy dielectric strength properties and that, as a mixture with inert compounds, they provide an effective electrical insulation even at relatively low temperature.

DESCRIPTION OF EMBODIMENTS OF THE INVENTION

The invention is now described in greater detail and in a nonlimiting manner in the description which follows.

The invention relates to a gas used as electrical insulation and/or extinguishing medium for electric arcs.

The gas according to the invention comprises at least one hexafluorobutene or HFO-1336. Preferably, it is a matter of 1,1,1,4,4,4-hexafluorobut-2-ene (or HFO-1336mzz) or else of 2,3,3,4,4,4-hexafluorobut-1-ene (or HFO-1336yf).

Alternatively, it is also possible to use 1,3,3,4,4,4-hexafluorobut-1-ene, 1,1,2,4,4,4-hexafluorobut-2-ene and/or 1,1,3,4,4,4-hexafluorobut-2-ene, for example.

The HFO-1336mzz can be in the cis form or in the trans form or can be a mixture of the two forms. Preferably, it is in the trans form (HFO-E-1336mzz). It is also possible to use a mixture of several hexafluorobutenes, for example a mixture of HFO-1336mzz and HFO-1336yf.

The gas can also comprise additional compounds, in particular a diluant (or dilution gas or buffer gas) and optionally one or more other halogenated compounds (in particular fluorinated compounds).

According to one embodiment, the gas according to the invention comprises (or optionally consists essentially of, or optionally consists of) a mixture of one or more HFO-1336 compounds and a diluant. Preferably, it is a binary mixture consisting of HFO-1336mzz and a diluant or consisting of HFO-1336yf and a diluant.

The diluant is an inert compound which can, for example, be chosen from air, nitrogen, methane, oxygen, nitrous oxide, helium and carbon dioxide. Mixtures of these are also possible.

According to one embodiment, the gas according to the invention comprises (or optionally consists essentially of, or optionally consists of) a mixture of one or more HFO-1336 compounds and one or more other halogenated compounds, or else one or more HFO-1336 compounds, at least one diluant, in particular as mentioned above, and one or more other halogenated compounds.

Mention may in particular be made, as halogenated compound which can be used as a mixture with HFO-1336, of a chlorocarbon, a hydrochlorocarbon, a chlorofluorocarbon, a hydrochlorofluorocarbon, a chloroolefin, a hydrochloroolefin, a chlorofluoroolefin or a hydrochlorofluoroolefin, a hydrochlorofluoroketone, a fluoroketone, a hydrofluoroketone, a hydrochloroketone or a chloroketone. Preferably, the halogenated compound is a hydrochlorofluoroolefin, a hydrofluoroolefin or a fluoroketone.

According to one embodiment, the halogenated compound is a fluorinated compound which is preferably chosen from fluoroketones, fluoroethers, fluoronitriles, fluorinated peroxides, fluoroamides and fluorinated ether oxides.

Decafluoro-2-methylbutan-3-one is a preferred halogenated compound.

It is preferably desired for the gas according to the invention not to undergo condensation for the whole of the projected operating temperature range. It is furthermore desired to use this gas at a sufficiently high pressure, in principle greater than $10^5$ Pa. Under these conditions, the use of a diluant makes it possible to avoid reaching the saturated vapor pressure of the HFO-1336 and of the other halogenated compounds optionally present in the whole of the projected operating temperature range.

Thus, a diluant is generally a compound exhibiting a boiling point which is lower than that of HFO-1336 and also exhibiting a lower electric strength (at a reference temperature which is, for example, 20° C.).

The operating absolute pressure of the gas according to the invention is preferably from 1 to 1.5 bar in the medium-voltage appliances and from 4 to 7 bar in the high-voltage appliances.

The terms "medium-voltage" and "high-voltage" are used here as normally accepted, namely that the term "medium-voltage" denotes a voltage which is greater than 1000 volts in alternating current and than 1500 volts in direct current but which does not exceed 52 000 volts in alternating current and 75 000 volts in direct current, while the term "high-voltage" denotes a voltage which is strictly greater than 52 000 volts in alternating current and than 75 000 volts in direct current.

In order to maximize the amount of HFO-1336 and of the other optional halogenated compounds, the following formula can be used:

$$P_{tot} = \frac{\sum_{i=1}^{N} P_i}{\sum_{i=1}^{N} \frac{P_i}{SVP_i}} + P_{dilution\ gas}$$

In this formula, $P_{tot}$ represents the operating pressure of the gas according to the invention, $P_i$ represents the partial pressure of the HFO-1336 and of the other halogenated compounds and $SVP_i$ represents the saturated vapor pressure of the HFO-1336 and of the other halogenated compounds. The pressures are given at the filling temperature, i.e. generally approximately 20° C.

The molar percentage of each compound is then approximately given by $M_i=(P_i/P_{tot})\times 100$.

However, it should be noted that, in some cases, it is possible to accept a small amount of liquid at low temperature, which can make it possible to use the HFO-1336 or the other halogenated compounds in amounts slightly greater than those defined above.

Generally, the gas according to the invention can be used in a temperature range, the lower limit of which has a value: from −30 to −25° C.; or from −25 to −20° C.; or from −20 to −15° C.; or from −15 to −10° C.; or from −10 to −5° C.; or from −5 to 0° C.; or from 0 to 5° C.; or from 5 to 10° C.; or from 10 to 15° C.; or from 15 to 20° C.

The embodiments in which a diluant gas is present make it possible generally to operate in a temperature range, the lower limit of which is lower than in the embodiments in which no diluant gas is present.

Thus, when the gas consists essentially of, or consists of, an HFO-1336 (or an HFO-1336 mixture), the lower limit of the temperature range is preferably greater than or equal to 0° C., or greater than or equal to 1° C., or greater than or equal to 3° C., or greater than or equal to 4° C., or greater than or equal to 5° C., or greater than or equal to 6° C., or greater than or equal to 7° C., or greater than or equal to 8° C., or greater than or equal to 9° C., or greater than or equal to 10° C., or greater than or equal to 11° C., or greater than or equal to 12° C.

When the gas consists essentially of, or consists of, HFO-1336yf, the lower limit of the temperature range is preferably greater than or equal to 0° C., or greater than or equal to 1° C., or greater than or equal to 2° C., or greater than or equal to 3° C., or greater than or equal to 4° C., or greater than or equal to 5° C.

When the gas consists essentially of, or consists of, HFO-E-1336mzz, the lower limit of the temperature range is preferably greater than or equal to 7° C., or greater than or equal to 8° C., or greater than or equal to 9° C., or greater than or equal to 10° C., or greater than or equal to 11° C., or greater than or equal to 12° C.

Preferably, the gas according to the invention exhibits a GWP of less than or equal to 20, more particularly of less than or equal to 15 or of less than or equal to 10, or of less than or equal to 7, or of less than or equal to 5, or of less than or equal to 4, or of less than or equal to 3.

The GWP is defined with respect to carbon dioxide and with respect to a period of time of 100 years, according to the method shown in "The Scientific Assessment of Ozone Depletion, 2002, A Report of the World Meteorological Association's Global Ozone Research and Monitoring Project".

The (molar) proportion of HFO-1336 in the gas can be, in some embodiments, from 1 to 2%; or from 2 to 3%; or from 3 to 4%; or from 4 to 5%; or from 5 to 6%; or from 6 to 7%; or from 7 to 8%; or from 8 to 9%; or from 9 to 10%; or from 10 to 12%; or from 12 to 14%; or from 14 to 16%; or from 16 to 18%; or from 18 to 20%; or from 20 to 22%; or from 22 to 24%; or from 24 to 26%; or from 26 to 28%; or from 28 to 30%; or from 30 to 35%; or from 35 to 40%; or from 40 to 45%; or from 45 to 50%; or from 50 to 55%; or from 55 to 60%; or from 60 to 70%; or from 70 to 80%; or from 80 to 90%; or from 90 to 100%.

The partial pressure of HFO-1336 in the gas at 20° C. can be, in some embodiments, from 0.002 to 0.004 MPa; or from 0.004 to 0.006 MPa; or from 0.006 to 0.008 MPa; or from 0.008 to 0.01 MPa; or from 0.01 to 0.012 MPa; or from 0.012 to 0.014 MPa; or from 0.014 to 0.016 MPa; or from 0.016 to 0.018 MPa; or from 0.018 to 0.02 MPa; or from 0.02 to 0.022 MPa; or from 0.022 to 0.024 MPa; or from 0.024 to 0.026 MPa; or from 0.026 to 0.028 MPa; or from 0.028 to 0.03 MPa; or from 0.03 to 0.032 MPa; or from 0.032 to 0.034 MPa; or from 0.034 to 0.036 MPa; or from 0.036 to 0.038 MPa; or from 0.038 to 0.04 MPa; or from 0.04 to 0.045 MPa; or from 0.045 to 0.05 MPa; or from 0.05 to 0.055 MPa; or from 0.055 to 0.06 MPa; or from 0.06 to 0.07 MPa; or from 0.07 to 0.08 MPa; or from 0.08 to 0.09 MPa; or from 0.09 to 0.1 MPa; or from 0.1 to 0.11 MPa; or from 0.11 to 0.12 MPa; or from 0.12 to 0.13 MPa; or of more than 0.13 MPa.

It is desirable for the electrical appliances to contain a relatively high amount of HFO-1336 (and optionally other halogenated and in particular fluorinated gases), in order for the dielectric, thermal and cutoff characteristics of the gases to be sufficient over the prescriptive or desired temperature range.

To do this, it is advantageous to use a heating device in combination with an electrical appliance, said heating device being triggered as a function of the temperature of the gas mixture, of its pressure or of its density.

For example, a heating resistance ideally placed at the lowest point of the appliance (point of convergence of the liquids condensed on the different parts inside the appliance, by gravitation) can be used.

A gas pressure greater than the test pressure (gas pressure in the appliance during the validation tests) defined by standard(s) is thus guaranteed.

For the same reasons, it is advantageous to provide thermal insulation of the walls of the appliance and/or thermal insulation of the plant or of the premises containing it and/or heating of this installation or of these premises.

EXAMPLES

The following examples illustrate the invention without limiting it.

Example 1—Pure Products

Dielectric strength measurements are carried out at 20° C. and at 1.3 bar in a homogeneous field, with an interelectrode distance of 12 mm.

The results are as follows, expressed in a relative manner as percentage of the dielectric strength of the reference gas $SF_6$:

HFO-E-1336mzz: 127%;

HFO-1336yf: 137%.

In view of their condensation temperature, the two compounds above can be used in the pure state at minimum temperatures of 4° C. for the HFO-1336yf and of 11° C. for the HFO-E-1336mzz, at a pressure of 1.14 bar. The dielectric strength values (with an interelectrode distance of 12 mm) are then as follows, still with respect to $SF_6$:

HFO-E-1336mzz at 11° C.: 115%;

HFO-1336yf at 4° C.: 128%.

Example 2—Mixtures with an Inert Compound

If the ideal gas model is used, 1 $m^3$ of gas at 1.3 bar and at 20° C. contains 53.33 moles, independently of the gas used. This same amount of gas, in the same volume, gives a pressure of 1.14478 bar at −15° C.

Still according to the ideal gas theory, each gas is considered independently of the other gases in the same volume. Thus, as the saturated pressure of HFO-E-1336mzz at −15° C. is 0.39 bar, the maximum number of moles in 1 $m^3$ of gas is 16.35 moles, if it is desired to avoid any condensation at this temperature.

As the total pressure is regarded as being equal to the sum of the partial pressures, the remaining pressure is 0.79 bar and the equivalent number of moles of inert compound to be added is 37. The HFO-E-1336mzz/inert compound mixture then comprises a molar composition of 30.6% of HFO-E-1336mzz and 69.4% of inert compound.

The saturated partial pressure of HFO-1336yf at −15° C. is 0.5151 bar. A calculation similar to the preceding one then shows that the maximum molar proportion of HFO-1336yf in an HFO-1336yf/inert compound mixture which makes it possible to avoid any condensation is approximately 45%.

As the dielectric strength of air is 54% of that of $SF_6$ at −15° C. and at 1.14 bar, it is possible to calculate the dielectric strength of the above binary mixtures under the same conditions:

30.6 mol % HFO-E-1336mzz+69.4 mol % air: 77%;

45 mol % HFO-1336yf+55 mol % air: 86%.

These results show that, at the temperature of −15° C., a mixture of inert compound and HFO-1336 improves the dielectric performance qualities of the inert compound. What is true for air is also true for $CO_2$, the dielectric strength of which is 51% of that of $SF_6$ at −15° C. and at 1.14 bar.

The HFO-1336 contents shown above were calculated according to the ideal gas theory.

However, in reality, the maximum content of HFO-1336 at vapor saturation at the temperature of −15° C. and at the pressure of 1.14 bar is greater than that predicted by the ideal gas theory. Thus, the HFO-1336/inert compound binary compositions of interest can comprise a greater HFO-1336 content than the values shown above. Correspondingly, the dielectric strength obtained can be greater than that calculated above.

The invention claimed is:

1. An electrical insulation and/or extinguishing gas for electric arcs, the gas comprising:

from 10 to 100 mol % of trans-1,1,1,4,4,4-hexafluorobut-2-ene; and/or from 25 to 100 mol % of 2,3,3,4,4,4-hexafluorobut-1-ene.

2. The gas of claim 1, wherein the gas is used in a medium-voltage electrical substation appliance.

3. The gas of claim 1, further comprising a diluent.

4. The gas of claim 1, wherein the gas is used in a temperature range, a lower limit of which has a value from −30 to 20° C.

5. The gas of claim 1, wherein the gas is used in a temperature range, a lower limit of which is greater than or equal to 0° C.

* * * * *